US007934560B2

(12) United States Patent
Roveri et al.

(10) Patent No.: US 7,934,560 B2
(45) Date of Patent: May 3, 2011

(54) FREE STANDING RISER SYSTEM AND METHOD OF INSTALLING SAME

(75) Inventors: Francisco Edward Roveri, Rio de Janeiro (BR); Cezar Augusto Silva Paulo, Rio de Janeiro (BR); Roberto Rodrigues, Rio de Janeiro (BR); Renato Brandão Mansano, Vila Velha (BR); Carlos Alberto Giacomin Pereira, Vitoria (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 444 days.

(21) Appl. No.: 12/100,960

(22) Filed: Apr. 10, 2008

(65) Prior Publication Data

US 2008/0223583 A1 Sep. 18, 2008

Related U.S. Application Data

(63) Continuation of application No. 11/218,926, filed on Sep. 1, 2005, now abandoned.

(51) Int. Cl.
*E21B 43/01* (2006.01)

(52) U.S. Cl. ..... 166/345; 166/344; 166/350; 166/351; 166/352; 166/367; 166/386; 405/224.2; 405/224.3

(58) Field of Classification Search ..... 166/345, 166/341, 343, 344, 346, 350–355, 367, 368, 166/382, 386; 405/224.2–224.4
See application file for complete search history.

(56) References Cited

U.S. PATENT DOCUMENTS

| | | | | | |
|---|---|---|---|---|---|
| 3,653,435 | A | * | 4/1972 | Reistle et al. | 166/366 |
| 3,999,617 | A | * | 12/1976 | Ilfrey et al. | 175/7 |
| 4,138,751 | A | * | 2/1979 | Kentosh | 441/5 |
| 4,182,584 | A | * | 1/1980 | Panicker et al. | 405/224.3 |
| 4,234,047 | A | * | 11/1980 | Mott | 175/5 |
| 4,367,055 | A | * | 1/1983 | Gentry et al. | 405/169 |
| 4,388,022 | A | * | 6/1983 | Gentry et al. | 405/224.3 |
| 4,400,109 | A | * | 8/1983 | Gentry et al. | 405/224.3 |
| 4,448,568 | A | * | 5/1984 | Gentry et al. | 405/168.3 |
| 4,478,586 | A | * | 10/1984 | Gentry et al. | 441/4 |
| 4,643,614 | A | * | 2/1987 | Laursen | 405/169 |
| 4,735,267 | A | * | 4/1988 | Stevens | 166/345 |
| 4,740,109 | A | * | 4/1988 | Horton | 405/224.2 |
| 4,762,180 | A | * | 8/1988 | Wybro et al. | 166/350 |
| 4,848,949 | A | * | 7/1989 | Castel | 403/12 |
| 4,878,694 | A | * | 11/1989 | Castel | 285/24 |
| 5,044,826 | A | * | 9/1991 | Forster | 405/169 |
| 5,046,896 | A | * | 9/1991 | Cole | 405/195.1 |
| 5,342,148 | A | * | 8/1994 | Huete et al. | 405/223.1 |
| 5,480,264 | A | * | 1/1996 | Hunter | 405/195.1 |
| 5,657,823 | A | * | 8/1997 | Kogure et al. | 166/340 |
| 6,042,303 | A | * | 3/2000 | Head | 405/195.1 |
| 6,082,391 | A | * | 7/2000 | Thiebaud et al. | 137/236.1 |
| 6,113,314 | A | * | 9/2000 | Campbell | 405/224 |

(Continued)

*Primary Examiner* — Thomas A Beach
*Assistant Examiner* — Matthew R Buck
(74) *Attorney, Agent, or Firm* — Sughrue Mion, PLLC

(57) ABSTRACT

A free standing riser system includes a riser, a subsea intervention unit, and an umbilical line. The riser includes interconnected joints linked to one another, a lower-end of the riser being coupled to a wellhead and an upper-end of the riser enclosed in a buoy assembly, including a terminal, the riser being maintained in an erect, substantially vertical position. The subsea intervention unit is provided above the riser, and includes three connections: one connection to the terminal of the riser, one connection to a flexible jumper that is connected to a FPU, and one connection that provides a vertical conveyance to an intervention rig.

17 Claims, 17 Drawing Sheets

U.S. PATENT DOCUMENTS 6,321,844 B1 * 11/2001 Thiebaud et al. ..... 166/345
6,453,838 B1 * 9/2002 Mowell et al. ..... 114/230.13
6,470,969 B1 * 10/2002 Sorhaug et al. ..... 166/355
6,729,398 B2 * 5/2004 Ringgenberg et al. ... 166/250.01
6,823,941 B2 * 11/2004 Donald ..... 166/368
6,837,311 B1 * 1/2005 Sele et al. ..... 166/353
6,848,863 B2 * 2/2005 Karayaka et al. ..... 405/211
6,854,930 B2 * 2/2005 Pionetti ..... 405/172
7,008,141 B2 * 3/2006 Fitzgerald et al. ..... 405/224.2
7,025,535 B2 * 4/2006 Chiesa et al. ..... 405/169
7,073,593 B2 * 7/2006 Hatton et al. ..... 166/367
7,100,694 B2 * 9/2006 Legras et al. ..... 166/350
7,104,330 B2 * 9/2006 Legras et al. ..... 166/367
7,404,695 B2 * 7/2008 Chenin ..... 405/224.3
7,434,624 B2 * 10/2008 Wilson ..... 166/368
7,572,085 B2 * 8/2009 Luppi ..... 405/158
2006/0000615 A1 * 1/2006 Choi ..... 166/352

* cited by examiner

FREE STANDING RISER SYSTEM AND METHOD OF INSTALLING SAME

CROSS-REFERENCE TO RELATED APPLICATION

This application is a Continuation of U.S. application Ser. No. 11/218,926 filed Sep. 1, 2005, which was published as US 2007/0044972, the disclosure of which is incorporated herein by reference.

FIELD OF THE INVENTION

A free standing riser system and a method for installing the same relate to a riser coupled at its lower-end to a wellhead and supported in an erect, substantially vertical position by a buoy assembly that encloses the upper-end of the riser. The system also includes a subsea intervention unit, with three connections, interlinked to a Floating Production Unit (FPU) through a flexible jumper. The system can be used for testing subsea petroleum production and can be applied to Early Production Systems (EPS) or to Long Duration Tests (LDT) and can also be utilized as a completion riser. The application refers also to the method of installation of such system.

BACKGROUND OF THE INVENTION

One of the well-known production systems utilizes a dynamically positioned offshore vessel fitted with a derrick and a riser constructed of drill pipe threaded joints and the riser's stability is provided by a tension applied to the top-end of the riser by a vessel tensioning system, which is located beneath the derrick. This production system has high operational costs because it utilizes a vessel that is not easily available.

The use of free standing riser is also known in production as well as in completion systems. For example, U.S. Pat. No. 4,234,047 (hereinafter the '047 reference) describes the use of a free standing drilling riser utilizing inflatable buoys installed in the upper-end of the riser. This system permits a quick disconnection of the floating vessel and the riser, which remains buoyantly in place on the sea bed, in a vertical position. Although the specification of the '047 reference does not explicitly address this technical aspect, the use of a rig vessel and a compensator are necessary for the handling of the upper section of the riser, as may be seen in the figures accompanying this reference.

A free standing riser including various annular chambers that control buoyancy is described in U.S. Pat. No. 4,646,840 (hereinafter the '840 reference). However, only anchored vessels may be used with this system since there is no swivel device for the riser. Thus, the arrangement described in the '840 reference provides little practicability for lowering a WCT utilizing the same production riser.

U.S. Pat. No. 4,762,180 describes a configuration with a wellhead, a riser, a riser tensioning buoy, and a WCT on top of the buoy, in that order. This configuration is not suitable for a Long Duration Test LDT since, after the referenced test, the resulting configuration does not include a typical arrangement of the equipment, namely a wellhead, a subsea WCT, a flowline supported at the seabed, and finally a riser in ascendant catenary to the FPU, in that order.

U.S. Pat. No. 5,046,896 (hereinafter the '896 reference) describes a riser with air filled buoys, instead of rigid buoys. The use of these air filled rigid buoys, although not directly addressed in the specification of the '896 reference, also requires a rig vessel and a compensator for handling the top section of the riser.

It is emphasized that, in all the free standing riser systems mentioned above, the technologies therein described require that the vessel be fitted with a derrick and compensator for handling the upper section of the riser (i.e., the section above the point of disconnection).

U.S. Pat. No. 6,082,391 and U.S. Pat. No. 6,321,844 describe a system for the conveyance of petroleum from the seabed in deep water to a floating structure at the surface, in which at least one rigid and straight riser is vertically positioned. This hybrid riser has a central rigid tubular structure and a cylindrical block of syntactic material that surrounds the rigid tubular structure. The cylindrical block provides both buoyancy and thermal insulation to the riser. A floating reservoir is provided above the riser. Multiple rigid pipes for receiving petroleum from the seabed are inserted in the syntactic material. Flexible pipes connect the rigid pipes to the floating structure. Thus, the rigid riser does not provide for passage through the floating reservoir. In addition, the riser, which includes multiple pipes and an insulation system, must be constructed and assembled at a dry location (i.e., on land). Once installed, its reutilization at a different water depth can be troublesome and quite limited, since the method of fabrication is by means of welding the joints.

FIG. 5 shows an example of a conventional free standing riser system. The stability of the system 200 is provided by the buoyancy of a buoy assembly 60 that is connected to the upper-end of the riser 50 by a tether 212. A flexible jumper 90 is connected to the end of a pipe 714 at the upper-end of the riser 50. The flexible jumper 90 is interconnected to an FPU. The lower-end 213 of the riser 50 is connected to a foundation 210 on the seabed. A spool 211 is used to connect the lower-end 213 to a pipe 214 installed on the seabed.

The system 200 in FIG. 5 requires the construction of a foundation 210, whose function is solely to anchor the riser 50 and to support the loads transmitted by the same.

Hence, in spite of the technological advances in the area, there is a continuing need for a free standing riser system including a riser formed of interconnected joints and being coupled at its lower-end to a subsea equipment, the riser being fitted with a subsea intervention unit. Such a system would provide easy access and maintenance of the well, allow easy installation and retrieval, and allow the system to be adapted to different water depths.

SUMMARY OF THE INVENTION

A first aspect of the invention is a free standing riser system for testing and operating a subsea petroleum production from a wellhead on a seabed to a Floating Production Unit (FPU). The system includes a free standing riser including a terminal, a subsea intervention unit, and an umbilical line. The riser includes interconnected joints linked to one another, a lower-end being coupled to a WCT and wellhead and an upper-end enclosed in a buoy assembly, the riser being maintained in an erect, substantially vertical position. The subsea intervention unit is provided above a riser terminal, and includes three connections, one connection to the terminal, one connection to a flexible jumper that is interconnected to the FPU, and one connection that provides a vertical conveyance to an intervention rig, for well maintenance.

The subsea intervention unit allows the subsea petroleum production to be conveyed to both the FPU and the intervention rig; and the umbilical line controls, monitors and transmits electrical and hydraulic energy, the umbilical line linking the FPU to the wellhead and being supported by the riser or provided in a free catenary mode.

An upper-end of the riser is enclosed in a buoy assembly with control devices for variable buoyancy, the buoy assembly serving to maintain the riser in an erect, substantially vertical position.

The subsea intervention unit includes an internal mandrel providing second and third connections, wherein the mandrel provides a conveyance throughout a Y-shaped divider, the Y-shaped divider within the mandrel including a first extension for vertical conveyance to the intervention rig and a second extension for connection with a production flow line, and the first extension includes an intervention valve, and the second extension includes a production valve.

An upper funnel guide fits to the mandrel, and a curved pipe segment can be joined to the second extension, the curved pipe segment being connected to the flexible jumper.

The subsea intervention unit also includes a connector providing the first connection with the terminal of the riser, wherein the mandrel is linked to the connector, and the connector is provided with a lower funnel guide.

The connector includes a metal sealing ring adapted to fit within a recess of complementary shape located in a mandrel of the terminal of the riser, the mandrel of the terminal including an isolation valve, the valve isolating the riser to allow removal of the subsea intervention unit.

The invention refers to a free standing riser to be used in Early Production System or in Long Duration Test, where the riser is also utilized for deployment of the WCT, providing significant savings in time Second and third aspects of the invention are installation methods of the free standing riser system.

BRIEF DESCRIPTION OF THE DRAWINGS

The above and other aspects of the present invention will become more apparent by describing in detail exemplary embodiments thereof with reference to the attached drawings in which:

FIGS. 6-18 illustrate an exemplary embodiment of a method of installing the free standing riser system.

FIG. 6 illustrates the hoisting of a buoy assembly that is transported by a barge.

FIG. 7 illustrates a tug transporting the barge and the buoy assembly to the installation location of the riser system.

FIG. 8 illustrates the connection of the buoy assembly to a semi-submersible platform, and the process of sliding the buoy assembly from the barge with the assistance of the tug.

FIG. 9 illustrates the buoy assembly separated from the barge, the buoy assembly being connected, in a free floating mode, to the semi-submersible platform and the tug.

FIG. 10 illustrates the process of keel hauling (i.e., a cargo transfer operation) in which the buoy assembly is provided under the semi-submersible platform.

FIG. 11 illustrates that, at the end of the keel hauling process, the buoy assembly is supported by the derrick of the semi-submersible platform by a cable.

FIG. 12 illustrates that the upper end of the buoy assembly is brought to the moon pool area of the semi-submersible platform. The weight of the buoy assembly is transferred to the tensioning system cables of the semi-submersible drilling platform.

FIG. 14 illustrates the lowering of the buoy assembly to the operational depth and the connection of the riser to the wellhead at the seabed, while air is injected into the buoy assembly.

FIG. 15 illustrates the installation of the production flexible jumper and the connection of the subsea intervention unit to the riser and buoy assembly with the aid of a flexible pipe installation vessel.

FIG. 16 illustrates how, after the connection of the jumper, the flexible pipe installation vessel navigates towards the FPU while unwinding a reel of the stowed jumper.

FIG. 17 illustrates the transfer of the end of the jumper to the FPU with the aid of auxiliary cables.

FIG. 18 illustrates the free standing riser system installed and ready for operation.

FIGS. 19 to 21 illustrate another exemplary embodiment of the method of installation of the riser system of the invention.

FIG. 21 shows the lowering of the buoy assembly and the connection of the lower end of the riser to the wellhead on the seabed.

DETAILED DESCRIPTION OF THE INVENTION

Figure 1:
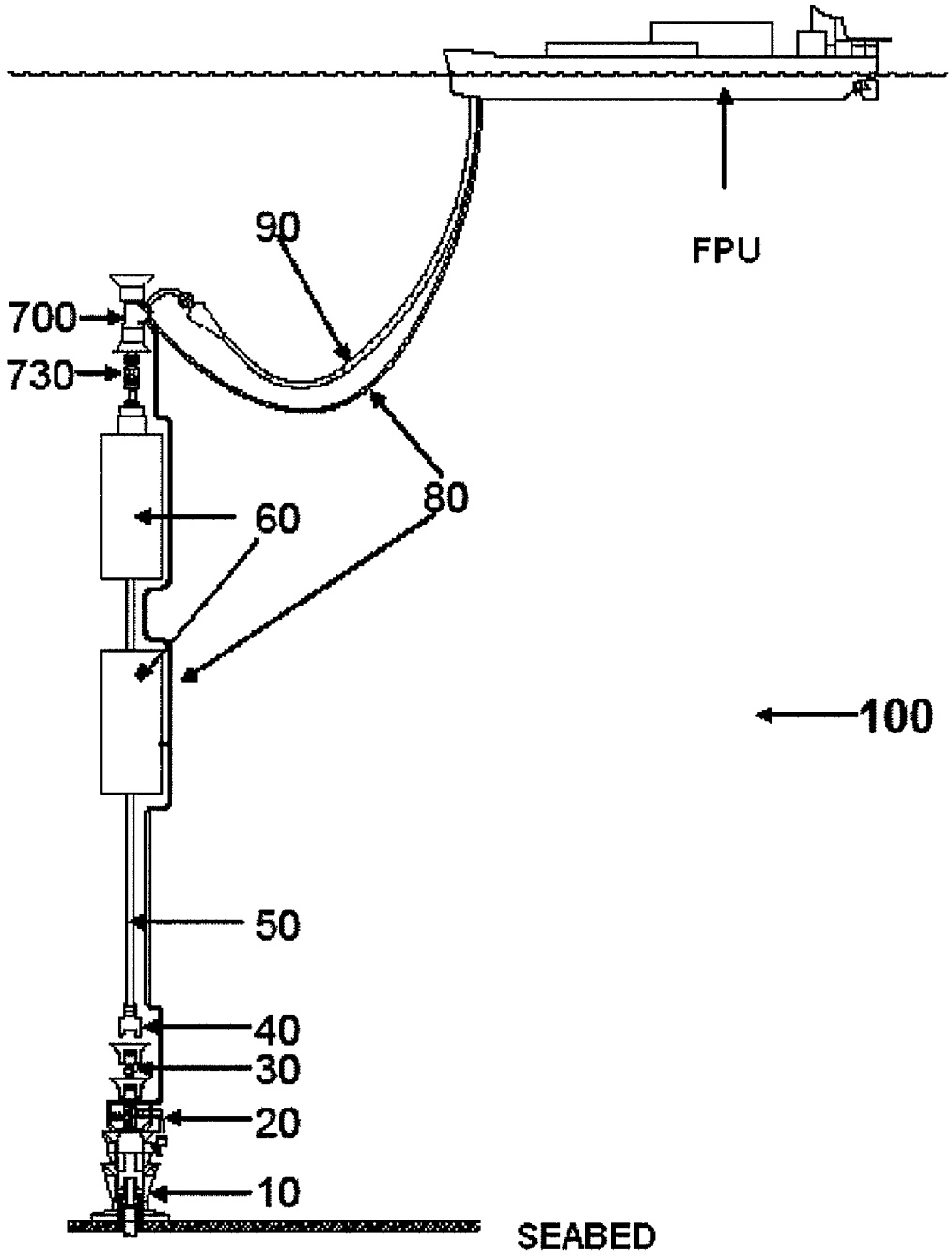
FIG. 1 is a schematic view of an exemplary embodiment of the invention in which an umbilical line is supported by the riser.

The following description relates in detail to exemplary embodiments which are illustrated in the accompanying drawings, wherein like reference numerals refer to like elements throughout. The following terms have the meaning described below:

A Long Duration Test (LDT) is a test of a well wherein the production is collected by the FPU during a period of from 2 to 6 months and periodically transported to a storage terminal located on land.

An Early Production System (EPS) is a provisional system installed to operate a few producing wells until the main production system is operational.

FIG. 1 shows an exemplary embodiment of the free standing riser system, including an umbilical line supported by the production riser. The free standing riser system 100 links a wellhead 10 on the seabed that can be connected to a WCT 20. The WCT 20 is provided with a blow-out preventer, (hereinafter, the workover BOP) 30, which is connected to the free standing riser 50 by a connection device 40. The free standing riser 50 is maintained in an erect, substantially vertical position under tension with the aid of a buoy assembly 60.

The free standing riser system 100 of the exemplary embodiment eliminates the need for a physical link to any vessel in order to provide this structural stability or to assure its coupling to the subsea equipment. The system is performed so that the riser 50 is enclosed by the buoy assembly 60.

The upper-end of the riser 50 is linked to an FPU by a flexible jumper 90, which conveys the oil produced by the wellhead 10 to this FPU.

The riser 50 is formed of interlinked joints joined by threads or a mechanical connector, and is connected at its lower-end to the WCT 20. An upper-end of the riser 50 is enclosed by the buoy assembly 60, which applies a vertical upward force that maintains the riser 50 in the erect, substancial vertical position.

The buoy assembly 60 may include buoys of various types, such as inflatable buoys, rigid solid buoys, rigid air filled buoys, or other types of buoys. The buoy assembly 60 may be a combination of similar buoys or of different types of buoys.

The buoy assembly 60 should permit variation in the total buoyancy force applied to the riser 50 since the buoy assembly is preferably installed and retrieved without a buoyancy load acting on the buoys (i.e., in a flooded or uninflated state). That is, the buoys should be deballasted or inflated to the necessary buoyancy only after installation of the riser system 100 and coupling on the seabed. In addition, the number of buoys installed will vary according to the water depth at which the riser 50 is installed.

In this exemplary embodiment, the preferred type of buoy 60 is an inflatable buoy because this type of buoy is easily manipulated due to its low weight and dimensions when uninflated, and furthermore, because the buoy may be inflated below the moon pool of the rig, where space is limited.

Figure 2:
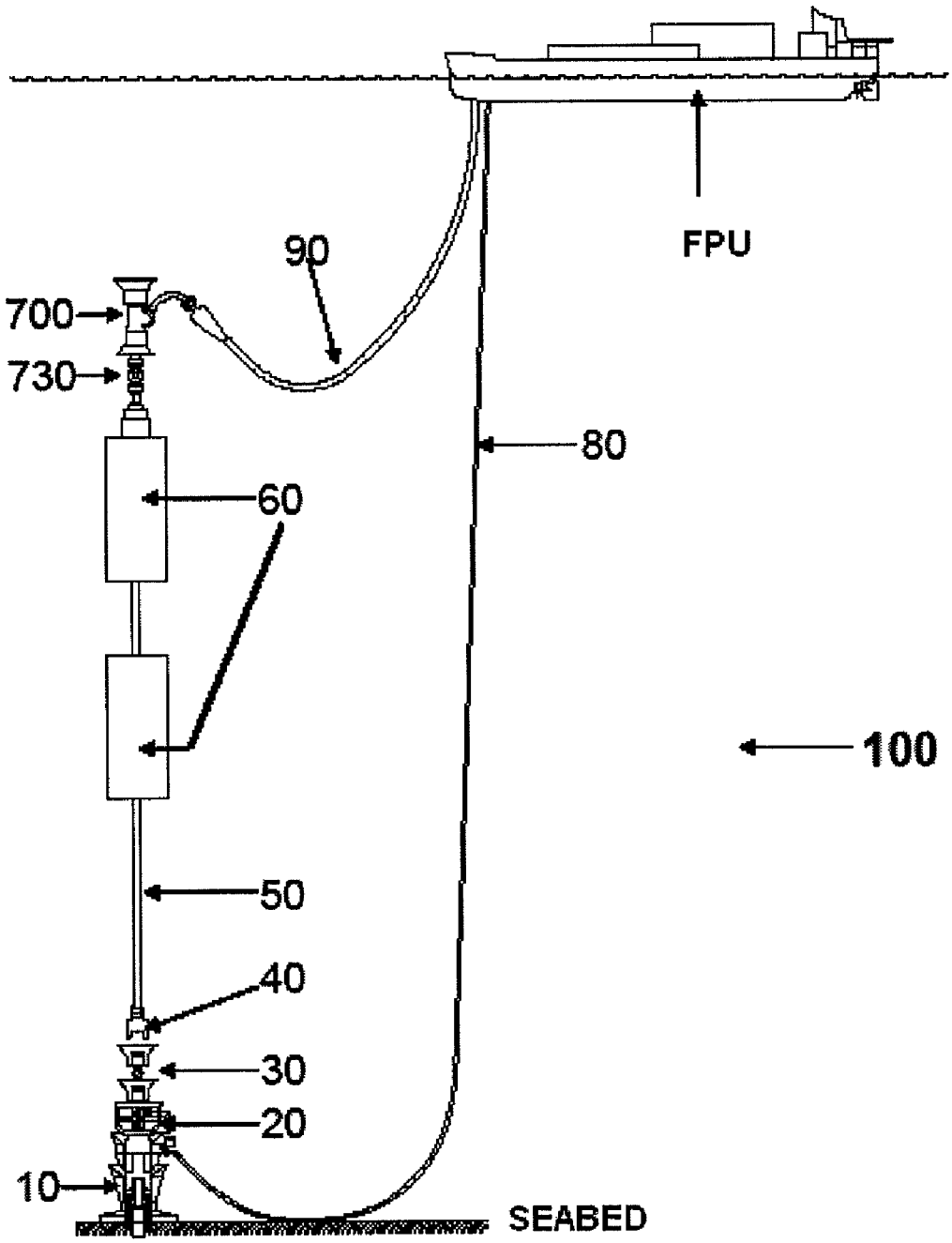
FIG. 2 is a schematic view of the exemplary embodiment of the invention, in which the umbilical line is in a free catenary mode.

The functions of controlling, monitoring and transmitting of electrical and hydraulic energy are accomplished with the aid of an umbilical line 80. The umbilical line 80 may be supported by the riser 50, as shown in FIG. 1 or, alternately, may be installed in the free catenary mode shown in FIG. 2. The umbilical line 80 can include interconnected segments, which permits the length of the umbilical line 80 to be adjusted according to the water depth where the system will be installed. For example, segments of 1,300 meters, 1,000 meters, 600 meters, 300 meters, and 100 meters can be combined to facilitate the construction of the required length.

Figure 3:
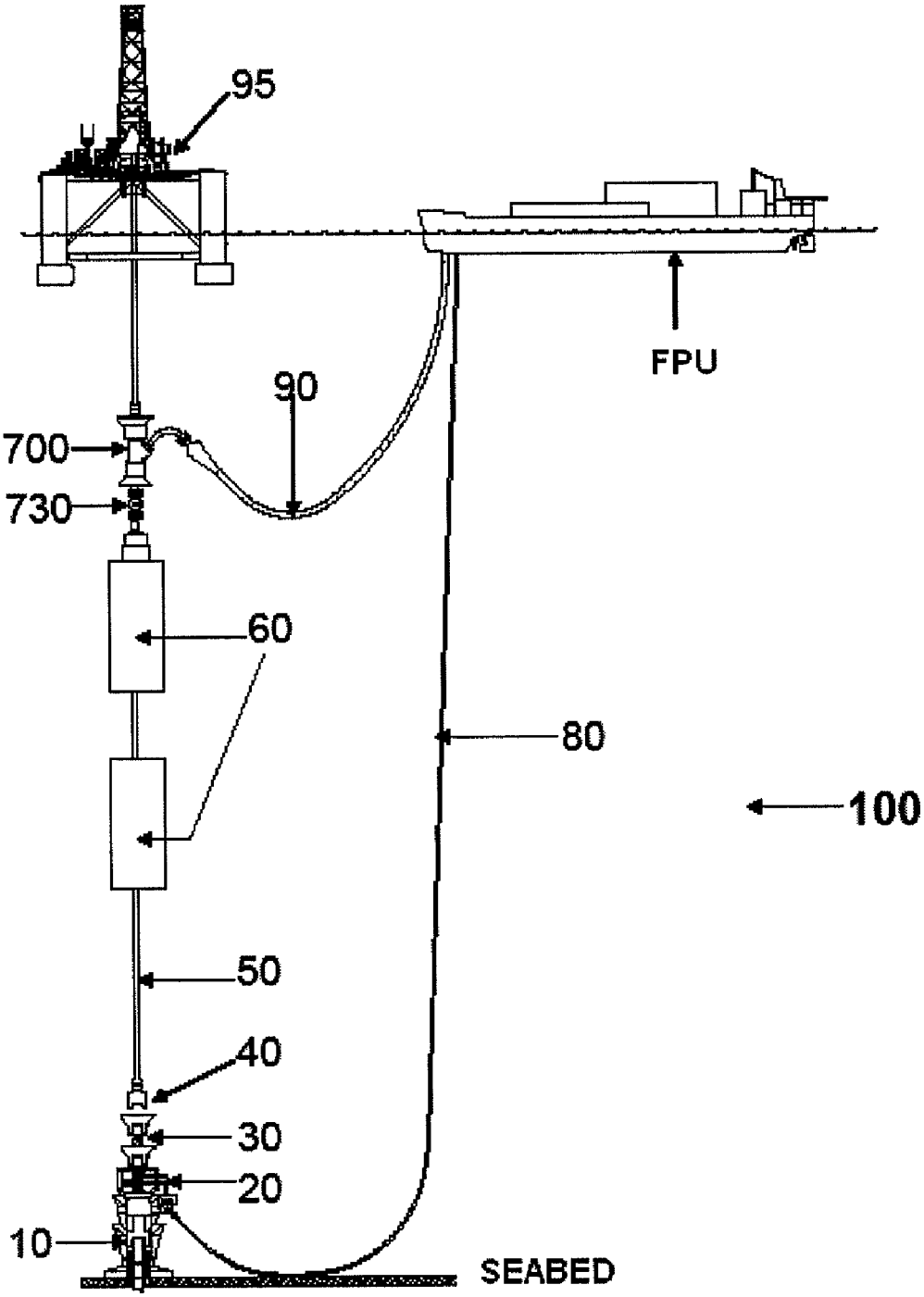
FIG. 3 is a schematic view of the exemplary embodiment with an intervention rig connected to a subsea intervention unit, which is provided above the riser.

FIG. 3 shows the exemplary embodiment with an intervention rig 95 coupled to a subsea intervention unit 700 of the free standing riser (100). The subsea intervention unit 700 is positioned above the riser 50, and thus above the buoy assembly 60. As shown in FIG. 3, the subsea intervention unit 700 includes three connections: a first connection to a terminal at the upper-end of the riser 50, a second connection to a flexible jumper 90, which in turn is connected to the FPU, and a third connection that provides a vertical connection to the intervention rig 95. The subsea intervention unit 700 allows the subsea petroleum production to be conveyed to both the FPU and the intervention rig 95.

Figure 4A:
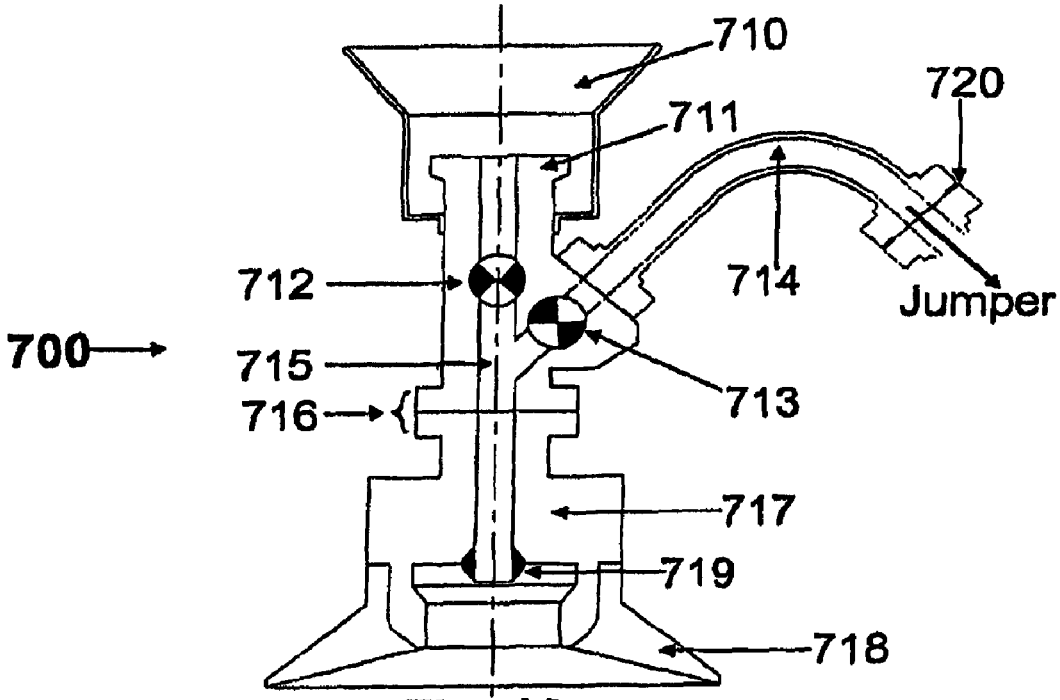
FIGS. 4A and 4B are schematic views of the subsea intervention unit and terminal of the riser, respectively.

As illustrated in FIG. 4A, the subsea intervention unit 700 includes a upper guide funnel (710), an internal mandrel 711, a connector 717, and a connection device 716, such as a flange, that connects the mandrel 711 to the connector 717, and a bottom guide funnel (718). A Y-shaped divider is provided within the internal mandrel 711, with a vertical conveyance of the production fluid and intervention tools from a passage 715 within the subsea intervention unit 700 to the first and second connections.

The first connection of the subsea intervention unit 700 includes a first extension of a Y-shaped divider that provides a vertical conveyance of the production fluid and intervention tools from a passage 715 within the subsea intervention unit 700 to an intervention rig 95. The upper guide funnel 710 is fitted on the mandrel 711, and an intervention valve 712 is positioned within the first extension of the Y-shaped divider.

The second connection of the subsea intervention unit 700 includes a second extension of the Y-shaped divider that is connected to a curved segment 714. A production valve 713 is positioned within the second extension of the Y-shaped divider. The curved segment 714 is shaped as a gooseneck and is connected to a flexible jumper 90 through a connection structure, such as a flange 720. The flexible jumper 90 is connected to the FPU.

The third connection of the subsea intervention unit 700 includes a lower part of the Y-shaped divider and the connector 717 which links the subsea intervention unit 700 to the terminal 730 at the upper-end of the riser 50. The inverted funnel guide 718 is fitted to the connector 717 and facilitates coupling to a terminal 730. The central part of the connector 717 has a metallic sealing ring 719, which provides a connection with a recess 731 within a mandrel 732 of the terminal 730, and as such provides the connection between the terminal 730 and the subsea intervention unit 700.

Figure 4B:
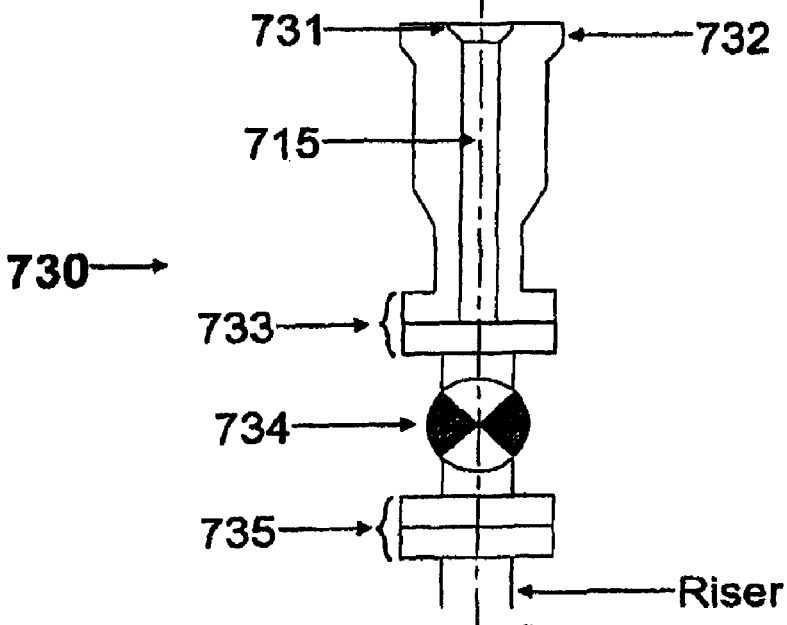

As shown in FIG. 4B, the terminal 730 includes the mandrel 732 and an isolation valve 734, provided at an upper-end of the riser 50. The mandrel 732 is connected to the isolation valve 734 by a connection device 733, such as a flange. The valve 734 is connected to the upper-end of the riser 50 by a connection device 735, such as a flange. The isolation valve 734 is utilized to isolate the riser 50, thereby permitting the retrieval of the subsea intervention unit 700 for maintenance. When there is a need for intervention at a wellhead 10, the valve 713 is closed, which provides isolation from the FPU, and the valve 712 is opened, which provides conveyance with the intervention rig 95.

In addition, the subsea intervention unit 700 permits the retrieval and maintenance of the jumper 90, inasmuch as the jumper is connected to the subsea intervention unit 700. The valve 734 within the terminal 730, when closed, permits uncoupling the subsea intervention unit 700 from the terminal 730, allowing maintenance.

In a manner distinct from the state of the art, the free standing riser system 100 if formed by threaded riser joints and is directly connected to the subsea wellhead, without the need of a vessel with a derrick.

In a manner distinct from the state of the art, the subsea intervention unit 700, which is coupled to the upper-end of the riser 50 permits an intervention (i.e., workover) in a production well through the interior of the riser 50 without the need to retrieve the free standing riser system 100 and the flexible jumper 90.

The FPU may be a Floating Production Storage and Offloading (FPSO). This vessel, which may be moored or may be of the Dynamic Positioning (DP) type, does not necessarily require a derrick. In case of the DP type vessel, an extra component, a swivel, is required to avoid the torsion of the flexible jumper 90 and riser 50 because the DP vessel may rotate (weathervane) along its own vertical axis during continuous operation. The swivel may be installed on the upper end of the riser 50 or at the entrance of the FPU. The entrance of the FPU is the preferred position since the maintenance and inspection of the swivel are facilitated at this position, and the swivel operates under lower external pressure.

The preferred use of the free standing riser system 100 is as a production riser. However, alternatively, this system also may be used as a completion riser, without the buoy assembly 60.

The system may either be used for producing naturally flowing wells or wells that require artificial lift pumping systems. If the riser system 100 is used for production through pumping, the production of the oil is accomplished through a subsea pumping module coupled to the WCT, with this subsea pumping module installed and retrieved via cable, as described in Applicant's Brazilian Patent application PI 0301255-7.

The advantages of the free standing riser system 100 include the following.

1) It is possible to deploy a WCT 20 utilizing the riser 50 itself.

2) riser 50 connected to the WCT 20 and to the buoy assembly 60

3) The subsea intervention unit 700 permits intervention and maintenance procedure on the well, thereby eliminating the need for retrieving any components of the riser system 100 during the procedure.

4) The riser 50 enclosed by the buoy assembly 60 simplifies the fabrication, assembly and installation of the free standing riser system 100.

5) The characteristics of the free standing riser system 100 make it appropriate for use in water depths up to 3,000 meters.

In this way, the free standing riser system 100 of the exemplary embodiment presents the following aspects which distinguish it from the prior art.

Figure 5:
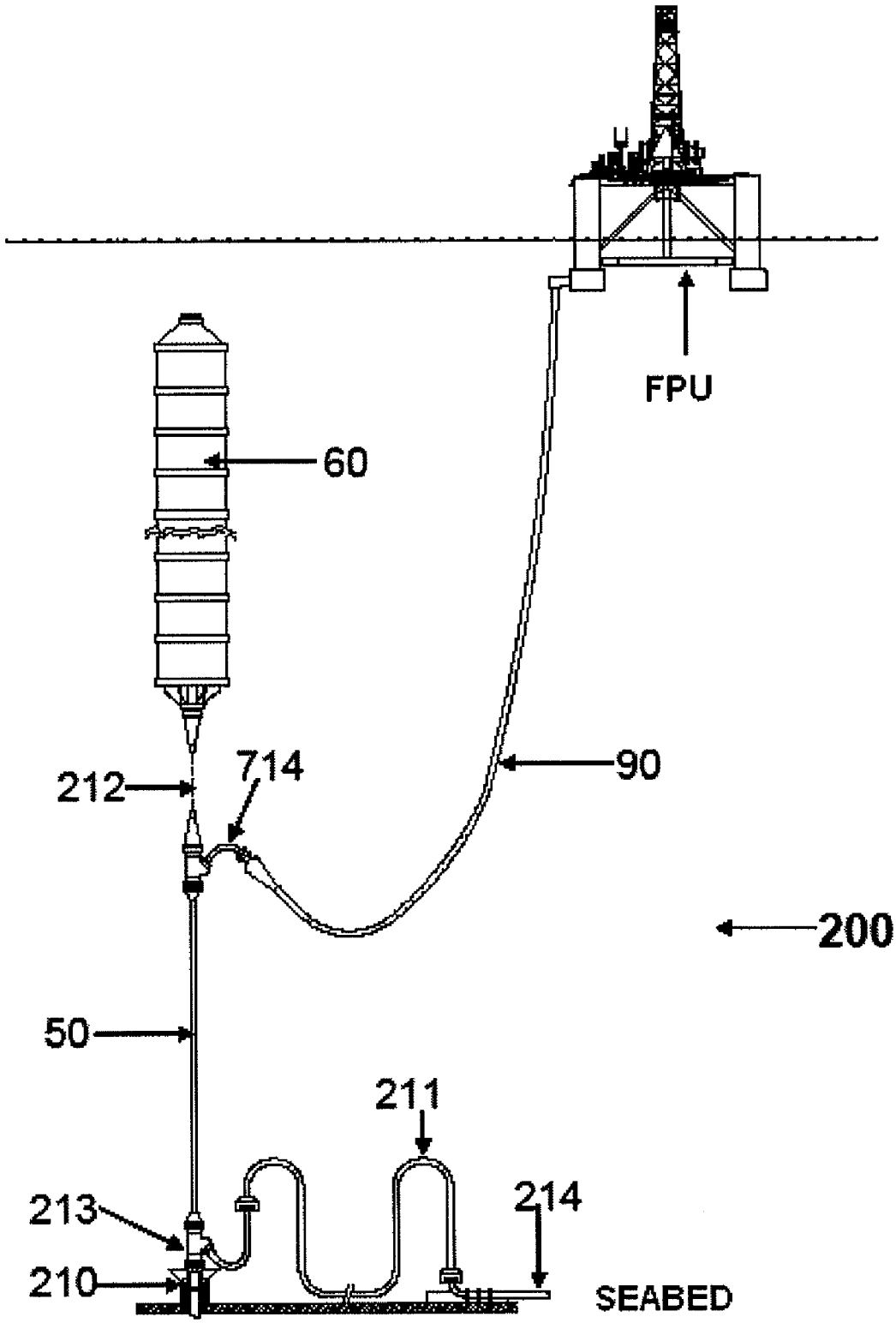
Fig. 5 PRIOR ART
FIG. 5 is a schematic view of a conventional free standing riser system.

1) It eliminates the need for constructing a foundation 210 and spools 211 interlinking the wellhead to the base of the riser 50, such as those found in the conventional system of FIG. 5.

2) It utilizes mechanical connectors and may be installed by a rig during the deployment operation of a WCT 20, as discussed below.

3) The subsea intervention unit 700, which permits intervention in the well while eliminating the need for removing the entire riser system 100, is provided at the upper-end of the riser 50, and permits the retrieval of the jumper 90 for maintenance of the same. On the contrary, the well-known systems would not permit the easy disconnection of the jumper 90.

4) The free standing riser system 100 makes it unnecessary to use an FPU with a DP system and a derrick for performing Long Duration Tests or Early Production System procedures.

5) The passage of a riser 50 enclosed by a buoy assembly 60, as discussed below, permits easy conveyance to the upper-end of the riser 50, with consequent advantages of direct and vertical access to the well.

Two exemplary methods of installing the free standing riser system 100 are contemplated. The first exemplary embodiment is shown in FIGS. 6 to 18. The second exemplary embodiment is shown in FIGS. 19 to 21.

Figure 6:
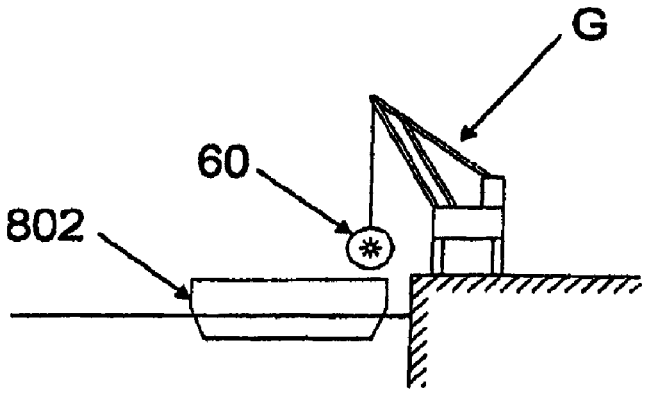
Figure 7:
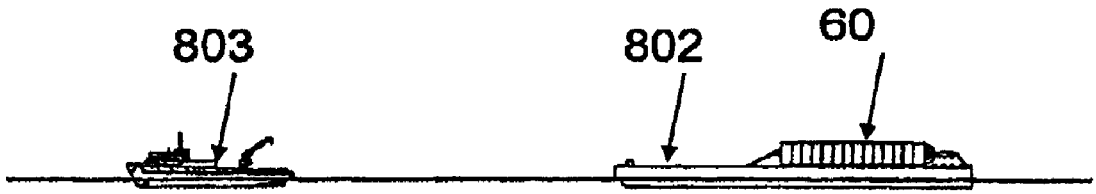
Figure 8:
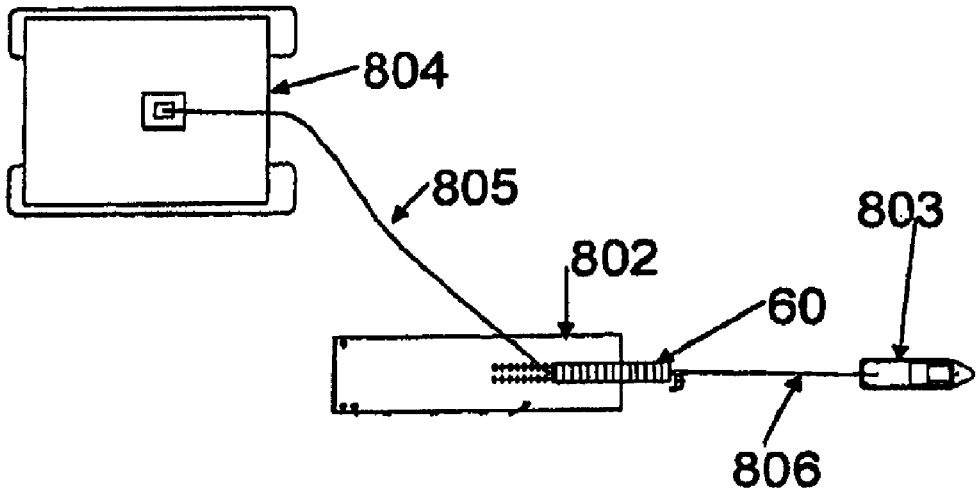
Figure 9:
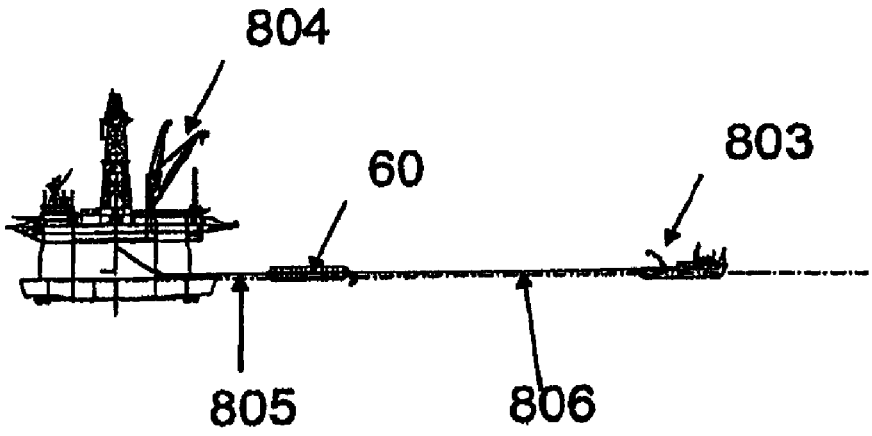
Figure 10:
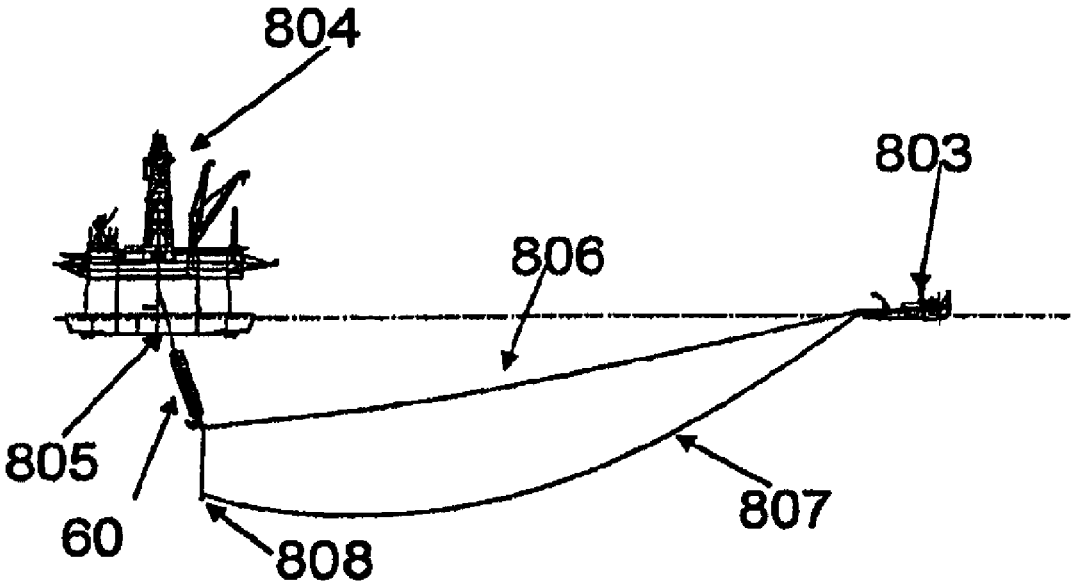
Figure 11:
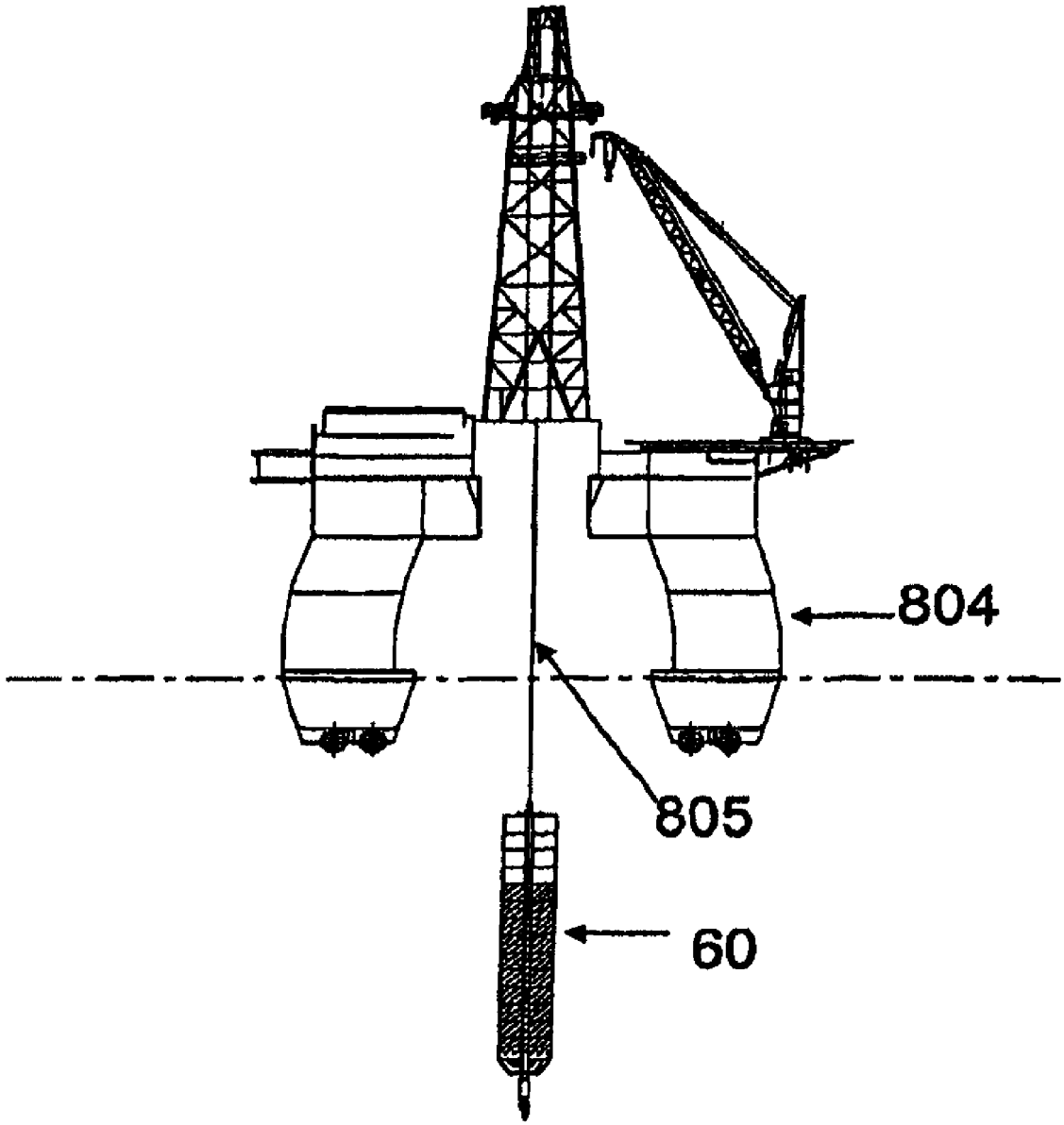
Figure 12:
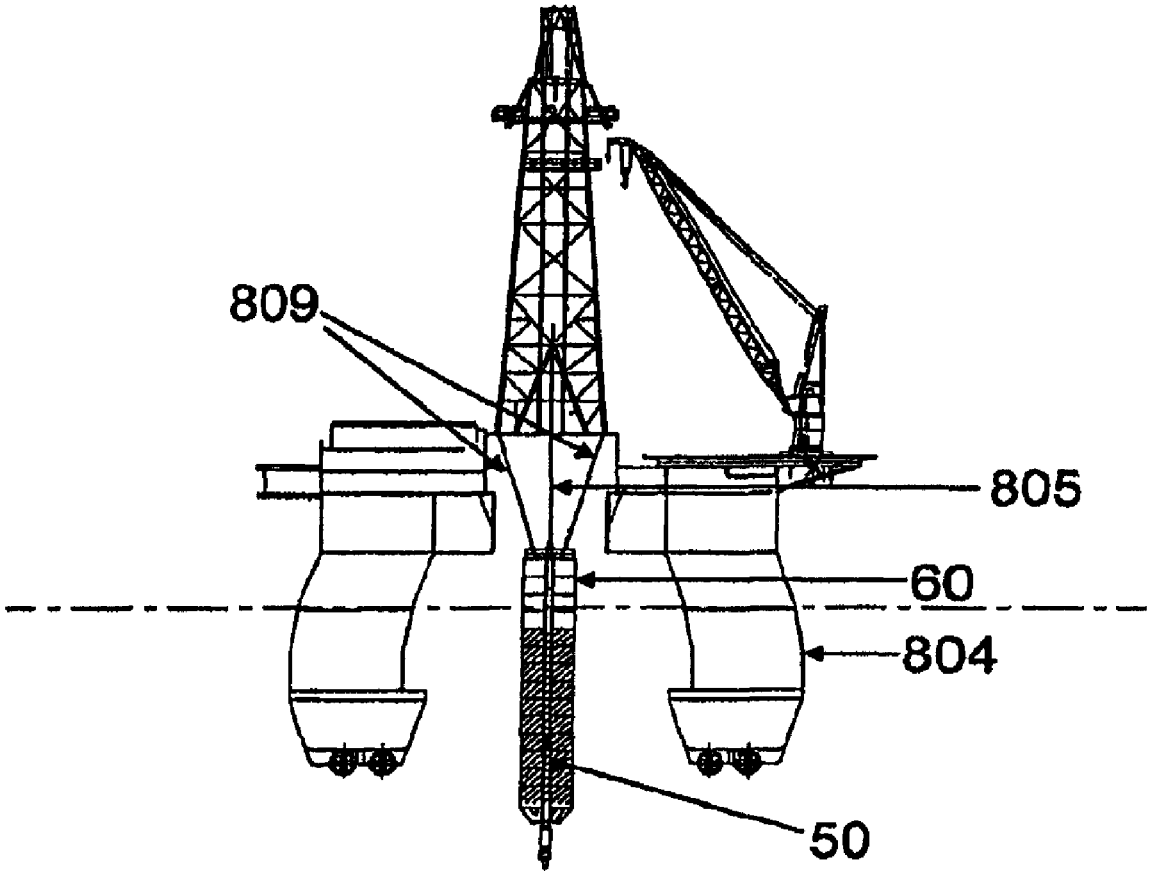
Figures 13A, 13B:
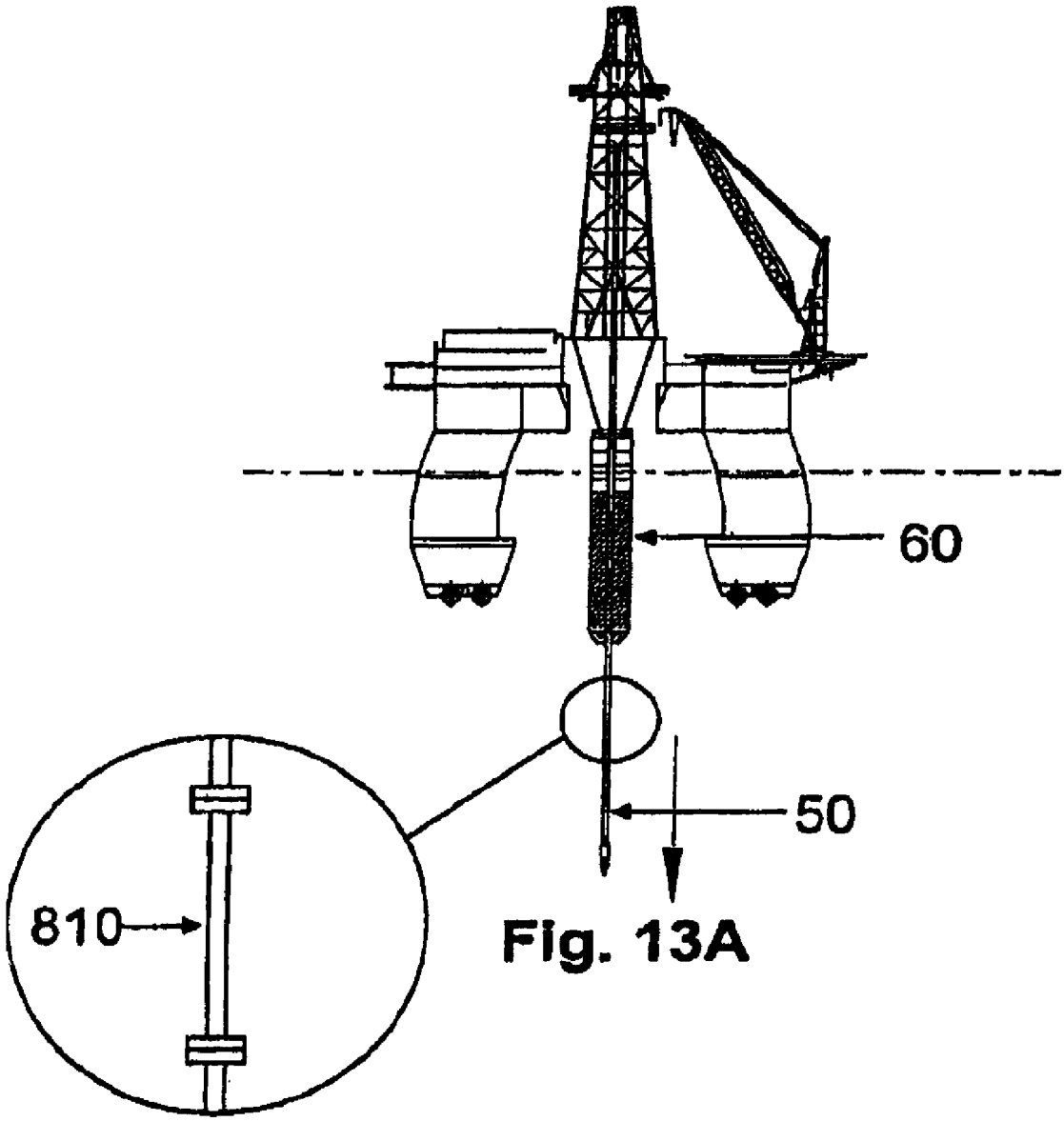
FIG. 13A illustrates that, after the cable which supports the buoy assembly is disconnected, riser joints, which form the riser, are connected and lowered through the inside of the buoy assembly until the required riser length is obtained.
FIG. 13B is a detailed view of the interconnected riser joints.
Figure 14:
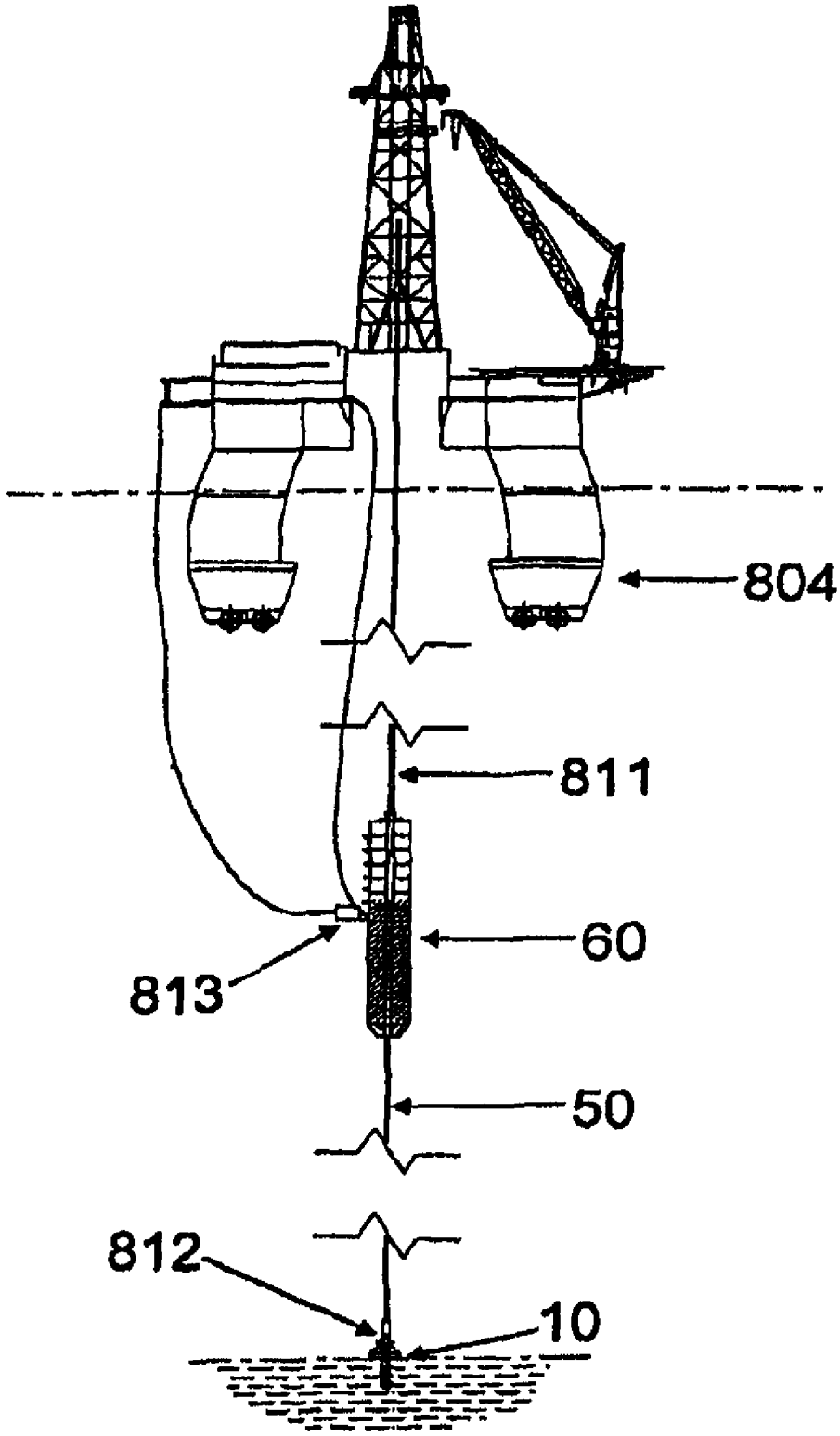
Figure 15:
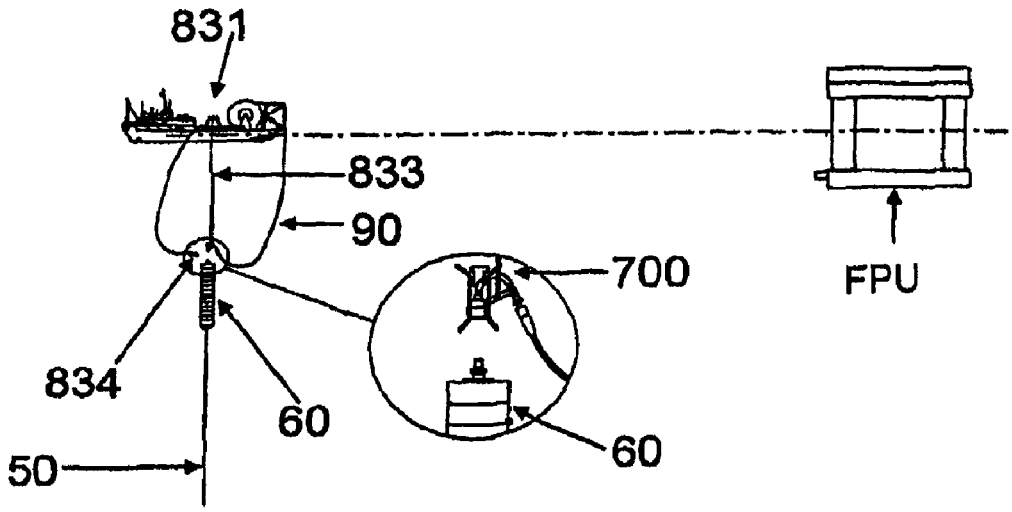
Figure 16:
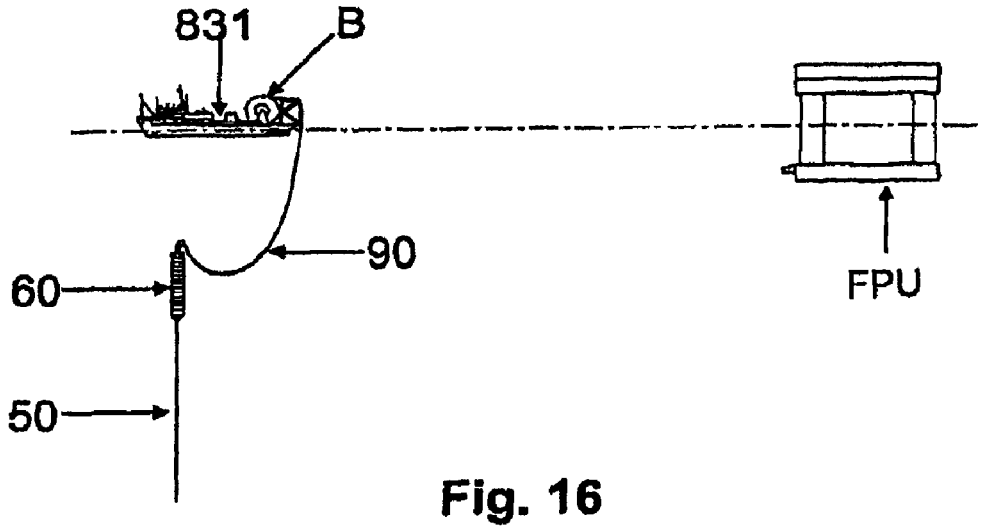
Figure 17:
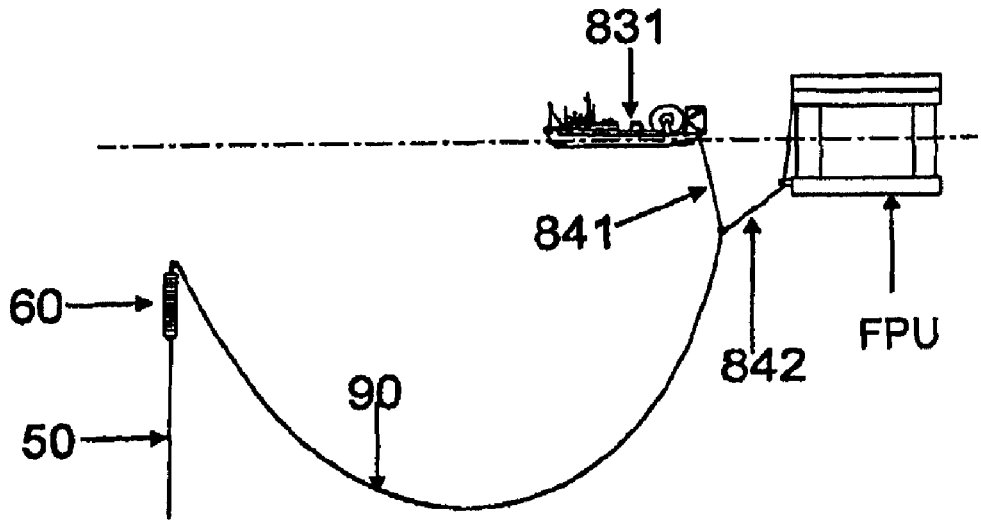
Figure 18:
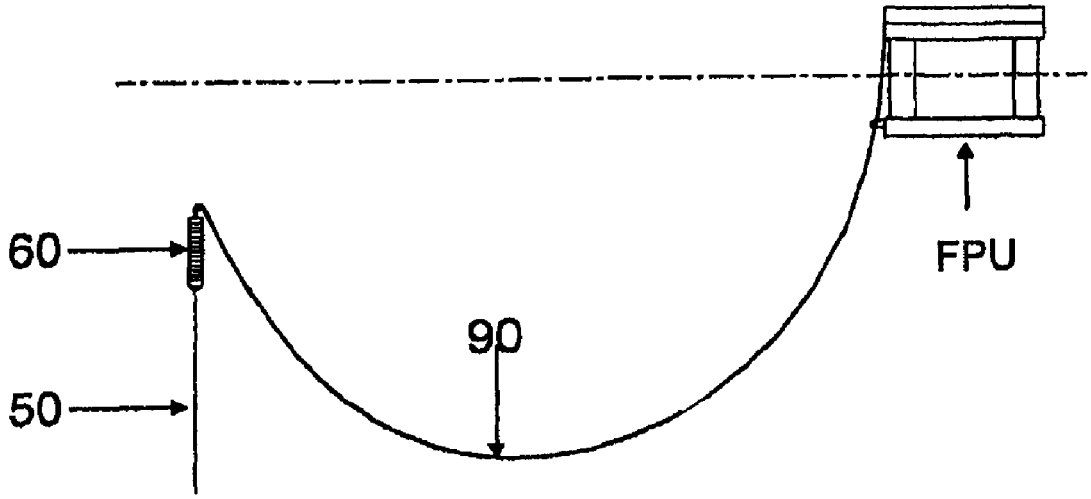

According to the first exemplary embodiment, generally shown in FIGS. 6 to 18, the installation method of the riser system (100) comprises the following operations:

a) Hoisting the buoy assembly 60, by a crane G, as shown in FIG. 6, from a dock and placing it in a transport barge 802. As an alternative, the buoy assembly 60 may be placed on the transport barge 802 sliding the buoy assembly 60 on the dock surface. Following the placement of the buoy assembly 60 on the transport barge 802, the buoy assembly 60 is fastened to avoid displacement of the buoy assembly 60 from the barge during the oceanic transport, as shown in FIG. 7.

b) Transporting the barge 802 and the buoy assembly 60 with the aid of a tug 803, as shown in FIG. 7, to the location at which the riser system 100 is to be installed.

c) Connecting the buoy assembly 60 to a installation platform 804, which is used for lowering the riser 50, with a cable 805, as shown in FIG. 8, and connecting the buoy assembly 60 to the tug 803 with a cable 806. The buoy assembly 60 remains on the transport barge 802.

d) Carrying out a partial controlled submersion of one of the ends of the transport barge 802 and sliding the buoy assembly 60 from the deck of the transport barge 802, while the cable 806 is pulled by the tug 803.

e) Separating and removing the transport barge 802 from the location. After that, the free floating buoy assembly 60 will be connected to the installation platform 804 by the cable 805 and connected to the tug 803 by the cable 806, as shown in FIG. 9.

f) Carrying out the process of keel hauling (i.e., a cargo transfer) the buoy assembly 60 under the installation platform 804 by appropriately maneuvering the cables 805 and 806 and an auxiliary cable 807 linked to the tug 803. The auxiliary cable 807 controls an anchor weight 808, connected to the lower end of the buoy assembly 60, as shown in FIG. 10. After keel hauling, the buoy assembly 60 will be hanged by the installation platform 804 through the cable 805, as shown in FIG. 11.

g) Bringing the upper-end of the buoy assembly 60 to the moon pool region of the installation platform 804, and transferring the weight of the buoy assembly 60 to tensioning system steel cables 809 of the platform 804, as shown in FIG. 12.

h) After the disconnection of the cable 805, connecting and lowering the joints 810 of the riser 50 within the buoy assembly 60 until the required length of the riser 50 is reached, and connecting the upper-end of the riser 50 to the buoy assembly 60, as shown in FIGS. 13A and 13B.

i) Lowering the buoy assembly 60 to the operational depth by a service pipe 811 of the installation platform 804, and then making a connection 812 between the lower-end of the riser 50 and the wellhead 10 on the seabed, as shown in FIG. 14.

j) Injecting air into the chambers of the buoy assembly 60 and dewatering the chambers using a remote operated vehicle (ROV) 813 in order to effect a positive buoyancy in the buoy assembly 60, the air volume required for riser 50 stability having been determined.

k) Disconnecting the service pipe 811 utilized for the lowering of the buoy assembly 60 and removing the installation platform 804 from the location.

l) With the aid of a flexible line installation vessel 831, installing the production flexible jumper 90 and the subsea intervention unit 700, which is coupled to the upper-end of the riser 50 and the buoy assembly 60, as shown in FIG. 15. The subsea intervention unit 700 is hanged during its lowering by a cable 833 of the installation vessel 831. The subsea intervention unit 700 is connected to the flexible production jumper 90, which provides an interconnection to the FPU. An ROV 834 is used during the procedure.

m) Moving the flexible line installation vessel 831 towards the FPU while unwinding a storage spool B of the flexible production jumper 90, as shown in FIG. 16.

n) Transferring the end of the production flexible jumper 90 to the FPU, utilizing auxiliary cables 841 and 842, to accomplish the pull-in operation, as shown in FIGS. 17 and 18.

o) Testing the free standing riser system 100; and p) Operating the free standing riser system 100.

Figure 19B:
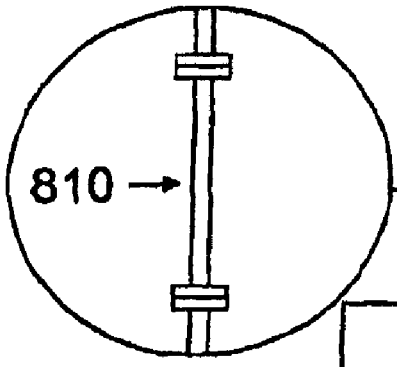
FIG. 19B is a detailed view of the interconnected riser joints.
Figure 19A:
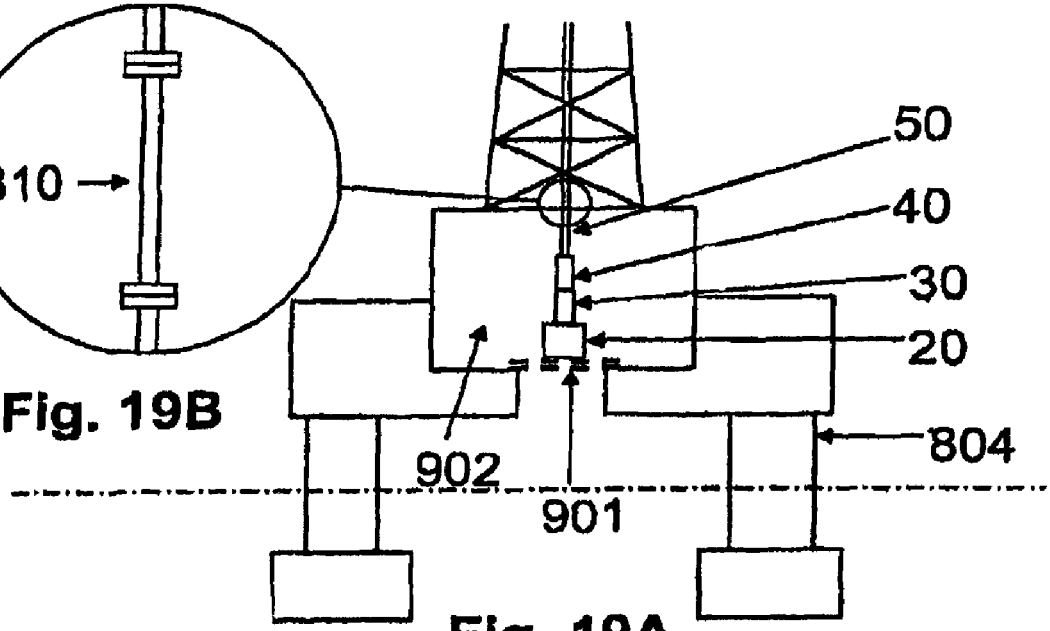
FIG. 19A illustrates the connection of the riser to a connection device.
Figures 20A, 20B, 20C:
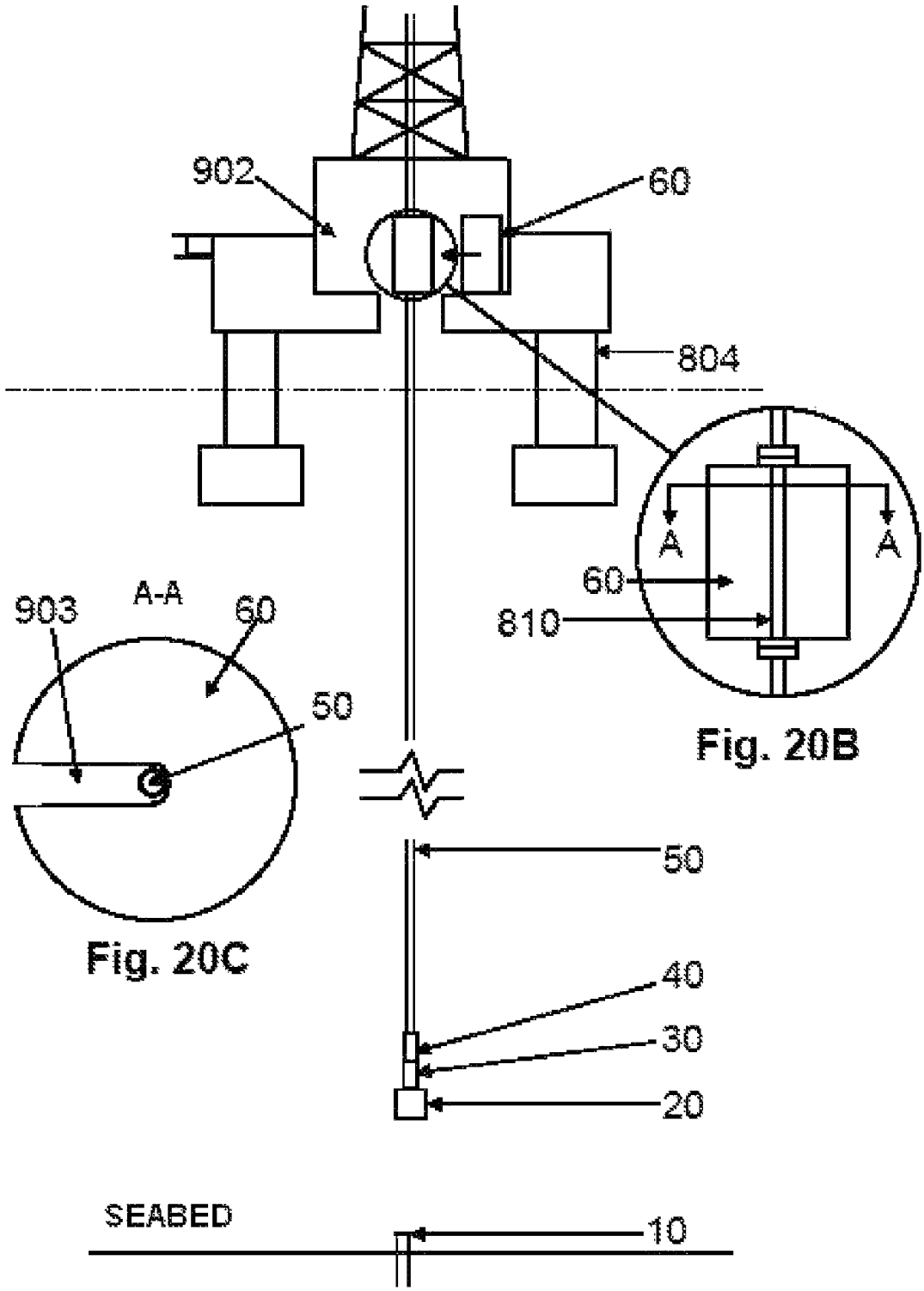
FIG. 20A illustrates the connection and lowering of the riser joints and the buoy assembly.
FIG. 20B is a detail of a riser joint connected to a buoy of the buoy assembly.
FIG. 20C shows a cross-section of the riser joint encased by the buoy assembly.
Figure 21:
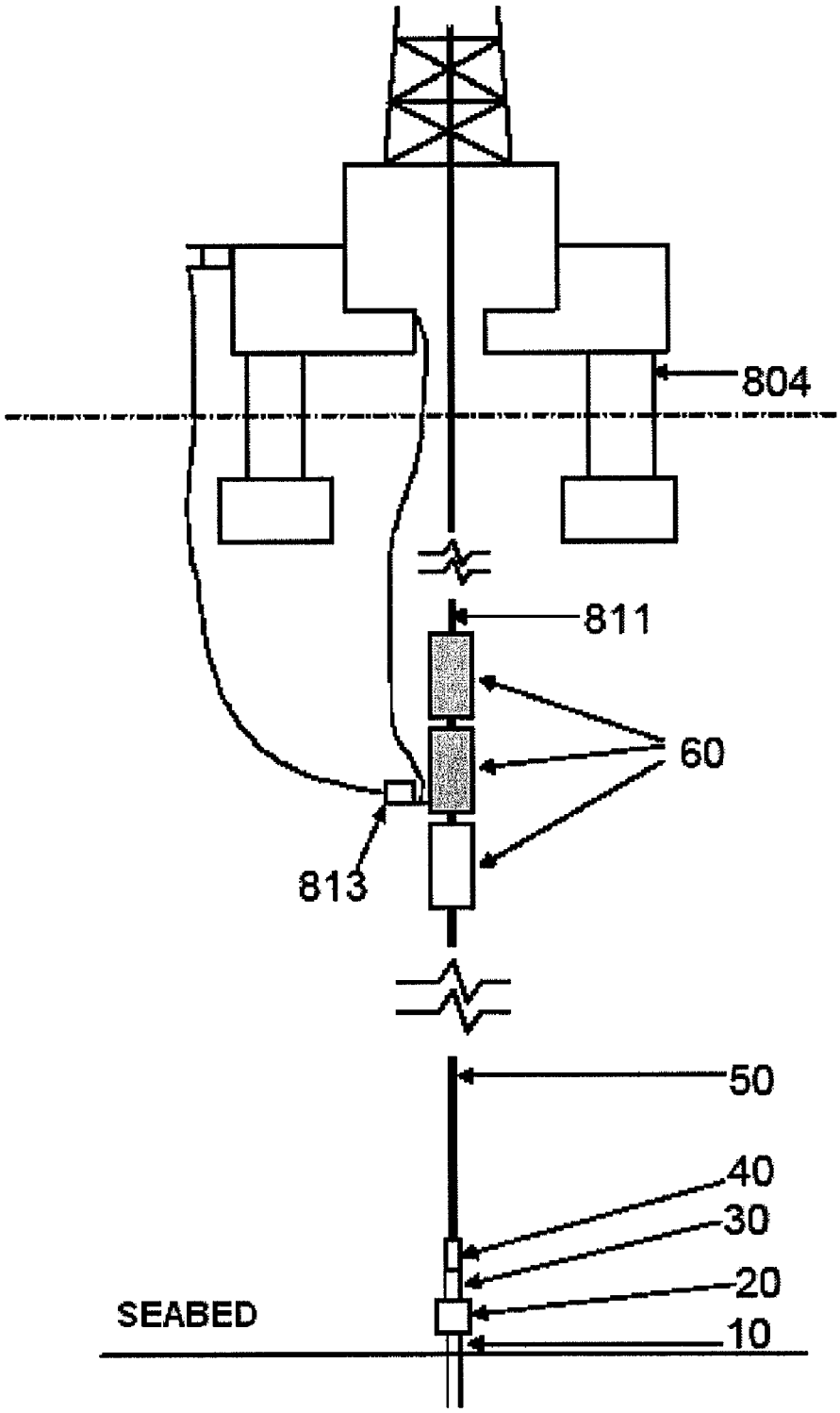

The second exemplary embodiment, shown on FIGS. 19 to 21, of the installation method of the free standing riser system 100 includes the following operations.

a) Assembling a WCT 20, a BOP preventer 30 and a connection device 40 on a temporary support unit 901, as shown in FIG. 19A; the temporary support unit 901 is located in the moon pool region 902 of a installation platform 804; and a riser 50, which is formed of interconnected riser joints 810, as shown in FIG. 19B, is connected to the connection device 40.

b) Connecting and lowering the riser joints 810 until the required length of the riser for the installation of a first buoy of the buoy assembly 60 is reached; maneuvering the first buoy in the moon pool region 902 of the installation platform 804 in order to enclose the riser joints 810 within the first buoy through the opening 903, so that the first buoy is attached to the riser joints 810, as shown in FIG. 20A and FIG. 20B. FIG. 20C shows an A-A cross section of a first buoy of the riser 50.

c) Connecting additional riser joints 810 and repeating this operation for the remaining buoys of the buoy assembly 60.

d) Lowering the buoy assembly 60 to an operational depth through a service pipe 811 of the installation platform 804, and then connecting the WCT 20 at the lower-end of the riser 50 to the wellhead 10 on the seabed, as shown in FIG. 21.

e) Injecting air into the buoy assembly 60 and dewatering the buoy assembly with the aid of the ROV 813 in order to produce a positive buoyancy to the buoy assembly 60, the air volume required for riser 50 stability having been determined, as also shown in FIG. 21.

f) Disconnecting the service pipe 811 utilized to lower the buoy assembly 60, and removing the installation platform 804 from the location.

g) Installing the production flexible jumper 90 and the subsea intervention unit 700 with the aid of a flexible line installation vessel 831, as discussed above with respect to the first embodiment as shown in FIG. 15.

h) Moving the flexible line installation vessel 831 towards the FPU while unwinding a storage spool B of the flexible production jumper 90, as discussed above with respect to the first embodiment and shown in FIG. 16.

i) Transferring the upper-end of the production flexible jumper 90 to the FPU, utilizing auxiliary cables 841 and 842, as discussed above with respect to the first embodiment and shown in FIGS. 17 and 18.

j) Testing the free standing riser system 100; and k) Operating the free standing riser system (100).

In both embodiments of the method of installing the free standing riser system 100 the test can be either an Early Production System (EPS) or, a Long Duration Test (LDT).

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A free standing riser system connecting a subsea petroleum production wellhead on the seabed and a Floating Production Unit (FPU), that allows the petroleum production to be conveyed to the FPU and to an intervention rig without the need to retrieve the free standing riser and a flexible jumper interconnected to the FPU, said system comprising:

a riser formed by interlinked joints with a lower-end being directly connected to the wellhead and enclosed in a buoy assembly installed below a terminal at the upper-end of the riser, the riser being maintained in an erect substantially vertical position by a tension applied by the buoy assembly;

a subsea intervention unit, coupled to the terminal at the upper-end of the riser, including a Y-shaped divider with three connections: a first connection to the terminal, a second connection with a valve to the flexible jumper, and a third connection with an intervention valve that provides a vertical direct access from the intervention rig to the wellhead through the interior of the riser;

an umbilical for controlling, monitoring and transmitting electrical and hydraulic energy, the umbilical linking the FPU to the wellhead; and wherein the subsea intervention unit includes in sequence: an upper guide funnel, an internal mandrel with the Y-shaped divider, a first connector and a bottom inverted guide funnel linking the internal mandrel to the terminal at the upper-end of the riser via a second connector and an isolation valve.

2. The free standing riser system according to claim 1, wherein the internal mandrel is connected to a curved pipe segment which is connected to the flexible jumper that is connected to the FPU.

3. The free standing riser system according to claim 1, wherein the second connector includes a metallic sealing ring providing connection within a mandrel of the terminal, the mandrel being connected to the isolation valve by a connection device to allow removal of the subsea intervention unit and flexible jumper.

4. The free standing riser system according to claim 1, wherein the FPU utilized is a Floating Production Storage and Offloading (FPSO).

5. The free standing riser system according to claim 4, wherein the FPSO is moored.

6. The free standing system according to claim 5, wherein the FPSO is a Dynamic Positioning (DP) type.

7. The free standing riser system according to claim 6, further comprising a swivel.

8. The free standing riser system according to claim 1, wherein during an intervention procedure, a production valve to the FPU is closed, and the intervention valve to the intervention rig is open.

9. The free standing riser system according to claim 1, wherein the riser can be used as a completion riser without the buoy assembly.

10. The free standing riser system according to claim 1, wherein a WCT is deployed during installation of the riser.

11. The free standing riser system according to claim 1, wherein the system may either be used for producing naturally flowing wells or wells that require artificial lift pumping systems.

12. An installation method for a free standing riser system connecting a subsea petroleum production wellhead on a seabed and a Floating Production Unit (FPU), said system comprising: a riser with a lower-end being coupled to the wellhead and an upper-end enclosed in a buoy assembly and including a terminal, the riser being maintained in an erect substantially vertical position by a tension applied by the buoy assembly; a subsea intervention unit, positioned above the riser, including a Y-shaped divider with three connections: one connection to the terminal at the upper end of the riser, one connection to a flexible jumper that is interconnected to the FPU, and one connection that provides a vertical access to the wellhead, wherein the subsea intervention unit allows the subsea petroleum production to be conveyed to both the FPU and an the intervention rig and allows workover tools to be run from the intervention unit in a direct and vertical access to the wellhead; and an umbilical line for controlling, monitoring and transmitting electrical and hydraulic energy, the umbilical line linking the FPU to the wellhead, the method comprising:

a) transporting by a barge the buoy assembly to a location at which said riser system is to be installed;

b) connecting the buoy assembly to an installation platform and to a tug;

c) performing a controlled partial submersion of one extremity of the barge;

d) sliding the buoy assembly off of the barge;

e) removing the barge from the location;

f) keel hauling the buoy assembly to underneath the installation platform so that the buoy assembly is hanged by the platform;

g) bringing an upper-end of the buoy assembly to a moon pool region of the installation platform and transferring the weight of the buoy assembly to cables of a tensioning system of the platform;

h) connecting and lowering interconnected joints until a required riser length is reached;

i) lowering the buoy assembly to an operational depth and connecting a lower end of the riser to the wellhead on the seabed;

j) injecting air into the buoy assembly for dewatering of compartments and providing tension to the riser system;

k) retrieving a service pipe used for the riser deployment;

l) removing the installation platform from the location;

l) deploying the flexible jumper and the subsea intervention unit to an upper-end of the riser with the aid of a flexible line installation vessel;

n) moving the flexible line installation vessel towards the FPU, while unwinding the flexible production jumper;

o) transferring an end of the production flexible jumper to the FPU;

p) testing an operation using the free standing riser system; and q) operating the free standing riser system.

13. The method according to claim 12, wherein the operation (p) is applied to an Early Production System.

14. The method according to claim 12, wherein the test of operation (p) is a Long Duration Test.

15. An installation method of a free standing riser system connecting a subsea petroleum production wellhead on a seabed and a Floating Production Unit (FPU), said system comprising: a riser with a lower-end being coupled to the wellhead and an upper-end enclosed in a buoy assembly and including a terminal, the riser being maintained in an erect substantially vertical position by a tension applied by the buoy assembly; a subsea intervention unit, positioned above the riser, including a Y-shaped divider with three connections: one connection to the terminal at the upper end of the riser, one connection to a flexible jumper that is interconnected to the FPU, and one connection that provides a vertical access to the wellhead, wherein the subsea intervention unit allows the subsea petroleum production to be conveyed to both the FPU and an the intervention rig and allows workover tools to be run from the intervention unit in a direct and vertical access to the wellhead; and an umbilical line for controlling, monitoring and transmitting electrical and hydraulic energy, the umbilical line linking the FPU to the wellhead, the method comprising:

a) mounting a WCT, a BOP preventer, and a connection device on a temporary support device located in a moon pool region of an installation platform;

b) connecting the production riser to the connection device;

c) connecting and lowering joints of the riser until a required length for installation of a first buoy of the buoy assembly; maneuvering the first buoy in the moon pool region so as to install a riser joint within the first buoy, and connecting the first buoy to the riser joint;

d) repeating operation c) for the remaining buoys of the buoy assembly;

e) lowering the buoy assembly to an operational depth and connecting a lower end of the riser to the wellhead on the seabed;

f) injecting air into the buoy assembly for dewatering compartments and providing tension to the riser system;

g) retrieving a service pipe used for the riser deployment;

h) removing the installation platform from the location;

i) deploying the flexible jumper and the subsea intervention unit to an upper-end of the riser with the aid of a flexible line installation vessel;

j) moving the flexible line installation vessel towards the FPU, while unwinding the flexible production jumper;

k) transferring an upper-end of the production flexible jumper to the FPU;

l) testing the free standing riser system; and m) operating the free standing riser system.

16. The method according to claim 15, wherein the test of operation (1) is an Early Production System test.

17. The method according to claim 15, wherein the test of operation (1) is a Long Duration Test.

* * * * *